US010176763B2

(12) United States Patent
Tusch

(10) Patent No.: US 10,176,763 B2
(45) Date of Patent: Jan. 8, 2019

(54) METHOD AND DEVICE FOR AMBIENT LIGHT ESTIMATION

(71) Applicant: Apical Ltd, Cambridge (GB)

(72) Inventor: Michael Tusch, London (GB)

(73) Assignee: Apical Ltd., Cambridge (GB)

( * ) Notice: Subject to any disclaimer, the term of this patent is extended or adjusted under 35 U.S.C. 154(b) by 338 days.

(21) Appl. No.: 14/659,300

(22) Filed: Mar. 16, 2015

(65) Prior Publication Data

US 2015/0194091 A1 Jul. 9, 2015

Related U.S. Application Data

(63) Continuation of application No. PCT/EP2013/069282, filed on Sep. 17, 2013.

(30) Foreign Application Priority Data

Sep. 17, 2012 (GB) ..... 1216572.6
Mar. 1, 2013 (GB) ..... 1303725.4

(51) Int. Cl.
*G09G 5/00* (2006.01)
*G09G 3/3283* (2016.01)
(Continued)

(52) U.S. Cl.
CPC ..... *G09G 3/3283* (2013.01); *G09G 3/3291* (2013.01); *G09G 3/3655* (2013.01); *G09G 5/00* (2013.01); *G09G 2300/0876* (2013.01); *G09G 2310/00* (2013.01); *G09G 2310/0272* (2013.01); *G09G 2310/0275* (2013.01); *G09G 2360/16* (2013.01); *G09G 2370/00* (2013.01); *G09G 2370/025* (2013.01); *G09G 2370/045* (2013.01); *G09G 2370/047* (2013.01); *G09G 2370/10* (2013.01); *G09G 2370/14* (2013.01)

(58) Field of Classification Search
CPC .. G09G 3/3283; G09G 3/3291; G09G 3/3655; G09G 5/00; G09G 2300/0876; G09G 2310/00; G09G 2310/0272; G09G 2310/0275; G09G 2360/16; G09G 2370/00; G09G 2370/025; G09G 2370/045; G09G 2370/047; G09G 2370/10; G09G 2370/14
See application file for complete search history.

(56) References Cited

U.S. PATENT DOCUMENTS 9,341,713 B2 * 5/2016 Lyuh ..... G01S 17/58
2008/0006762 A1 * 1/2008 Fadell ..... G01J 1/4204 250/201.1

(Continued)

FOREIGN PATENT DOCUMENTS

EP 2112807 A1 10/2009
JP 2008158104 A 7/2008

OTHER PUBLICATIONS

International Search Report and Written Opinion issued in related PCT/EP2013/069282 dated Apr. 7, 2014.

*Primary Examiner* — Nelson Rosario
(74) *Attorney, Agent, or Firm* — EIP US LLP

(57) ABSTRACT

A method of forming a control parameter dependent on ambient light. The method comprises the steps of acquiring light values from an ambient light sensor and acquiring positional status values from a positional status sensor. The control parameter depends on the light values and is filtered in dependence on the positional status values.

25 Claims, 4 Drawing Sheets

(51) Int. Cl.
*G09G 3/3291* (2016.01)
*G09G 3/36* (2006.01)

(56) References Cited

U.S. PATENT DOCUMENTS

| | | | |
|---|---|---|---|
| 2009/0303215 | A1 | 12/2009 | Shiozaki |
| 2010/0207879 | A1 | 8/2010 | Fadell et al. |
| 2012/0133790 | A1 | 5/2012 | Sams |

* cited by examiner

METHOD AND DEVICE FOR AMBIENT LIGHT ESTIMATION

CROSS-REFERENCE TO RELATED APPLICATIONS

This application is a continuation of International Application No. PCT/EP2013/069282, filed Sep. 17, 2013, which claims the benefit of GB Application No. 1216572.6, filed Sep. 17, 2012. Each of the above-referenced patent applications is incorporated by reference in its entirety.

BACKGROUND OF THE INVENTION

Field of the Invention

The present invention relates to a method and system for ambient light estimation and to a display including such a system.

Description of the Related Technology

A method for measuring ambient light using an ambient light sensor is known in the art. The method can be used among others for deriving a control parameter for controlling the brightness of the display of a portable device, such as a mobile phone, tablet and laptop computer.

A disadvantage of the known method is that the adaptation of the brightness to the ambient light value is inadequate.

SUMMARY

In accordance with embodiments, there is provided a new method of forming a control parameter dependent on ambient light, the method comprising the steps of acquiring light values from an ambient light sensor; acquiring positional status values from a positional status sensor; and forming the control parameter in dependence on the light values by filtering in dependence on the positional status values.

The prior art method provides under some conditions values of the control parameter that are inappropriate for the intended purpose. For example, when the measured ambient light value is used for deriving a control parameter for the brightness of a display, the brightness may change rapidly and noticeably to a viewer under conditions when the measured ambient light value changes rapidly or is unreliable. The control parameter should, however, adapt the brightness in such a way that the changes should be barely noticeable to the viewer.

The new method combines measurements taken by an ambient light sensor and measurements taken by a positional status sensor. Positional status relates to translational position, angular position, translational motion and/or angular motion; motion includes velocity and acceleration. The positional status sensor measures preferably the positional status of the ambient light sensor, preferably with respect to ambient light sources, i.e. the positional status in the lighting environment, and may be mechanically connected to the ambient light sensor.

Since different illumination environments show a characteristic dependence of the measured light value on the positional status of the ambient light detector, the measurement of both ambient light and positional status allows to determine the illumination environment. For example, a diffuse lighting environment can be distinguished from a spot lighting environment by rotating a device including the two sensors and measuring the dependence of the measured light value on the positional status: the measured light value will hardly change in a diffuse lighting environment, whereas it will change in a spot lighting environment. The filtering in dependence on the positional status allows to differentiate between variations in light values due to changing ambient light conditions in the environment and variations due to the relative translational or angular position of the ambient light sensor itself or fluctuations in light values due to errors in the measurement of the light value measurement while the actual ambient light is unchanging. The control parameter is a parameter dependent on the light values and may be a filtered or averaged value of the ambient light, the brightness of a display or the strength of dynamic range adjustment, etc.

The method makes it possible to adapt or correct the value of the control parameter when the measured light value shows a predetermined dependence on translational position, angular position, translational and/or angular motion of the ambient light sensor, characteristic for a specific illumination environment, e.g. by changing the filtering used to form the control parameter. The control parameter may represent the variation in measured light value with respect to positional status. The value of the control parameter can be tuned to a specific purpose by making a specially adapted combination. For example, the value of the control parameter can be made to depend on the diffuse illumination or on the spot illumination. When tuned to controlling the brightness of a display, the control parameter can be made dependent mainly on the diffuse illumination, making the brightness changes of the display less noticeable to a viewer than those of the prior art, thereby improving the viewing of the display by a user.

In accordance with further embodiments there is provided a system for forming a control parameter dependent on ambient light, the system comprising an ambient light sensor, a positional status sensor and a combiner, an output of the ambient light sensor and an output of the positional status sensor being connected to inputs of the combiner, and the combiner being adapted to provide a value of the control parameter dependent on the light values and filtered in dependence on the positional status values.

Further features will become apparent from the following description of embodiments, given by way of example only, which is made with reference to the accompanying drawings.

DETAILED DESCRIPTION OF CERTAIN INVENTIVE EMBODIMENTS

Figure 1:
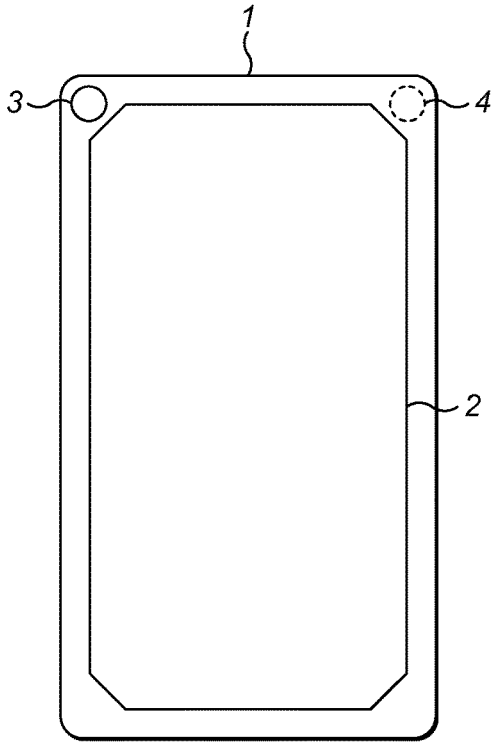
FIG. 1 shows a device including an ambient light sensor and a positional status sensor.

FIG. 1 shows a schematic drawing of a device 1, including a display 2, an ambient light sensor 3 and a positional status sensor 4. The device may be portable and may be a mobile telephone as shown in the figure, a tablet, a laptop computer, a computer monitor, or any device including a display. The ambient light sensor and the positional status sensor in this embodiment are part of the device and are both mechanically connected to a housing or frame of the device.

The ambient light sensor 3 is a conventional light sensor capable of measuring a light value, i.e. a light level of the incident ambient light. The sensor is may be integrated in the device, such that the incident light captured by the sensor provides a fair estimate of the ambient light incident on the display. Ambient light is defined as the environmental lighting in which the device is being used, which may be composed of different sources including direct or spot illuminators and diffuse illuminators.

The positional status sensor 4 can be a position sensor and/or a motion sensor. The positional status sensor is mechanically connected to the ambient light sensor and measures the positional status of the ambient light sensor. The sensor 4 in the figure is shown by a dashed line to indicate that the sensor is located inside the device 1. The positional status sensor can be a translational position sensor, such as a Global Positioning System (GPS) receiver and/or an angular or rotational position sensor, such as a gyroscope. The positional status sensor can also be a translational motion sensor, such as an accelerometer or a GPS receiver including a differentiator, and/or an angular or rotational motion sensor, such as a gyroscope including a differentiator. In general, a motion sensor may be based on a position sensor or an accelerometer.

Figure 2:
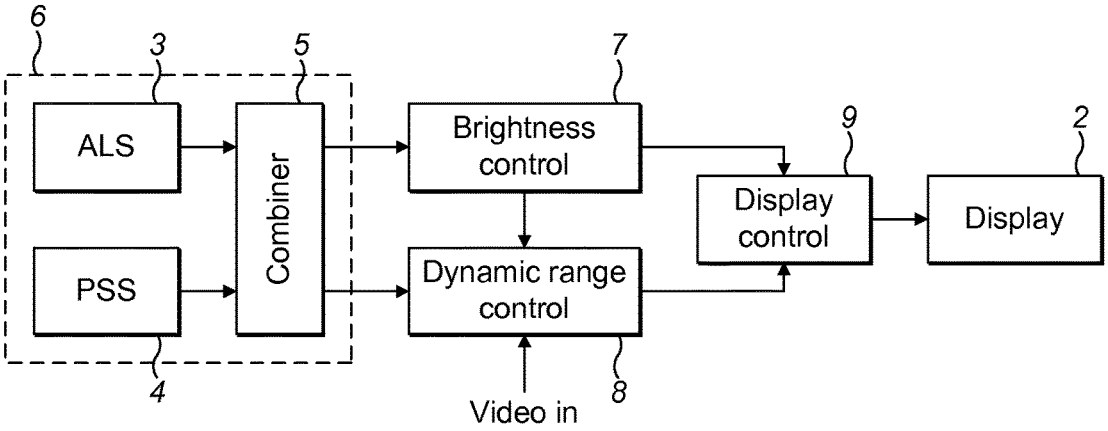
FIG. 2 shows a circuit diagram of the device.

FIG. 2 shows a circuit diagram for processing the outputs of the ambient light sensor and the positional status sensor. Light values acquired by the ambient light sensor 3 and positional status values from the positional status sensor 4 are input in a combiner 5. The combiner processes the light values and the positional status values to a value of one or more parameters. The sensors 3 and 4 and the combiner 5 form a system 6 for determining the value of the one or more parameters dependent on the ambient light and the positional status. The value of the parameter may be proportional to the amount of ambient light or to the amount of spot illumination or the amount of diffuse illumination. FIG. 2 shows a use of the system in a display control system adapted for controlling the display 2 of the device 1 in FIG. 1. The combiner 5 is connected to a brightness control unit 7 and to a dynamic range control unit 8 and provides parameter input for both units.

An output of the brightness control unit 7 is input to a display controller 9, where it may be used for improving the viewing by for example controlling the display brightness. The brightness control is dependent on a control parameter input from the combiner 5, which is derived from the ambient light. The brightness control is used, for example, for setting the intensity of a backlight of the display or for setting the maximum brightness of a pixel such as in an OLED display. The control usually sets the display brightness to low in dark ambient light conditions and to high in high ambient light conditions. Adjustment of the display brightness may for example be achieved by implementing a look-up table providing the value of display brightness for a given measured light value.

The dynamic range control unit 8, which may be a video processor, adjusts the pixel values of the display. The adjustment is dependent on a control parameter input from the combiner 5, derived from the ambient light. The adjustment is used to alter the appearance of imagery displayed in order to improve the viewing experience. Adjustment of the pixel values may for example be achieved by applying a tone curve having a shape dependent on the measured light value to the input pixel values, by applying a gamma correction having an exponent defined by the measured light value to the input image or video, by adjusting the histogram of pixel values, or by applying a spatially-varying transform which acts to reduce the dynamic range of the pixel values. The dynamic range of the data to be displayed may be controlled to be smaller than or equal to a dynamic range of the display. The output of the dynamic range compression unit, for example a video stream, is input to the display controller 9.

The output of the display control system, including elements 5, 7, 8 and 9, is connected to the display 2. The display, e.g. an LCD, OLED or electrowetting display, forms an image of the content for viewing by a user. Whereas the embodiment in FIG. 2 shows the use of both brightness control and dynamic range control in the display control system, alternative embodiments effect the control of the display by either the brightness control unit 7 or the dynamic range compression unit 8.

Displays are known in the prior art where the display brightness and the video content adjustment is controlled only by an ambient light sensor. The control may produce rapid and noticeable changes in the display appearance to the viewer under conditions where the estimation of ambient light is either rapidly changing or unreliable. The problem is caused by the measured ambient light value being different from the true value of the ambient light incident on the display. The difference may be caused by inaccuracy in the ambient light measurement, e.g. due to limitation in field of view, which may be caused by a bezel in which the ambient light sensor is placed, or shading of the sensor by the viewer. The difference may also be caused by the inability of the ambient light sensor to distinguish spot illumination from diffuse illumination. Hence, a rapid change in measured light value may not indicate a commensurate change in real ambient light conditions of the display. The known control of the display by low-pass temporal filtering of the output of the ambient light sensor does, however, not differentiate between variations in the light value due to changing ambient light conditions in the environment and variations due to the relative position of the ambient light sensor itself or fluctuations in the measured light value due to errors in the measurement while the actual ambient light is unchanging.

The above disadvantages in the control of the prior art displays are mitigated or removed by a control in which light values and positional status values are combined and filtered as shown in FIG. 2. The filtering of the measured light values in dependence on the positional status values provides an indication of the type of illumination environment in which the device is being viewed, based on known variation of light values with device orientation or motion in diffuse and spot lighting conditions, including change in orientation and speed of motion. Ambient light is often composed of both diffuse illumination and spot illumination. The method offers the ability to measure each component by measuring the variation of the ambient light with orientation. When changes in measured light values correlate with measured angular motion, the ambient light sensor is probably in a spotlight environment and the changes do not reflect changes in diffuse illumination. When changes in measured light values are accompanied by measured positional motion, the ambient light sensor may be probably moving through an environment with variations in light and shade, such as in a moving car, and the changes will reflect temporal changes in diffuse illumination.

By selecting a specific way of combining the values, the control parameter may distinguish between diffuse illumination and spot illumination. The control parameter can be made dependent mainly or only on the diffuse illumination or mainly or only on the spot illumination. Dependence on a specific combination of diffuse and spot illumination is also possible. The diffuse illumination level is usually a better measure for controlling the brightness of a display than a combined spot and diffuse illumination level as used in the prior art. The control parameter may differentiate between changes in light value due to changes in the ambient light and due to changes in the positional status of the device. The control of the display brightness and the control of the pixel values may require a different dependence of the respective control parameters on the light values for a suitable adaptation of the display to the lighting conditions. For example, when the ambient light is changing rapidly, the display brightness may respond slower than the pixel values to avoid visible flicker. This can be achieved by averaging the light values over a longer period for controlling the display brightness than for controlling the pixel values.

The combiner 5 outputs parameter values to the brightness controller 7 for setting the display brightness. The control parameter may be the display brightness B depending on the light values x, defined by $$B_i=\mathrm{LUT}(x_i);\langle B\rangle_i=(1-a)\langle B\rangle_{i-1}+aB_i \quad (1)$$

The display brightness $B_i$ is related via a look-up table (LUT) to the current light value $x_i$ obtained from the ambient light sensor 3. The average display brightness $\langle B\rangle_i$ output to the brightness controller 7, is obtained by recursive filtering of the values of $B_i$. Parameter a is a recursive filtering coefficient and the average is taken over successive values in time.

The combiner 5 may also output parameter values to the dynamic range controller 8 for setting for example the gamma correction. The control parameter may be the strength S of dynamic range adjustment of pixel values, defined by $$S_i=\mathrm{LUT}(x_i);\langle S\rangle_i=(1-b)\langle S\rangle_{i-1}+bS_i \quad (2)$$

The parameter $S_i$, output to the dynamic range controller 8, may be proportional to the exponent of gamma correction. Parameter b is a recursive filtering coefficient and the average is taken over successive values in time.

The larger the filtering parameters a and b, the more rapidly the display brightness and pixel values are adjusted to changes in the measured light value. The value of the parameters a and b, determining the speed of adaptation of the display to changes in the ambient light, may depend on the viewing conditions or the type of lighting environment. The type of lighting environment may be determined by the variation of the light value, the variation of the positional status value and/or the relation between the light value and the positional status value. Other linear and non-linear averaging methods may be used for determining an average value of B and S.

The variation of the measured light value or the positional status value may be determined by combiner 5 as the following exemplary scaled variance measure $$X_t=(N\langle x\rangle^2)^{-1}\Sigma_i(x_i-\langle x\rangle)^2$$

where N light values or positional status values $x_i$ are taken over a defined time period between times t and t+δt and $\langle x\rangle$ is the average of the N levels. The averaging period δt depends on the sampling rate of the ambient light sensor or positional status sensor and is typically between 2 and 30 seconds. A usual sampling rate is 10 samples per second. If δt is 5 seconds, N is 50 for the usual sampling rate.

The variation of the light values is a suitable parameter for comparison with the positional status values, allowing to make a clear distinction between different illuminations. The variation may be the variance of the light values.

The relation between the light value $x_i$ and the positional status value $y_i$ can, for example, be determined by the combiner 5 as the temporal covariance $C_t$ of pairs of sensor readings $$C_t(X,Y)=(N\langle x\rangle\langle y\rangle)^{-1}\Sigma_i|(x_i-\langle x\rangle)(y_i-\langle y\rangle)|$$

The positional status values may for example consist of a gyroscope reading over which the average or maximal absolute value is taken over the three axes. This example does not take account of motion direction; hence $y_i=|y_i|$ for all i.

The embodiment of FIG. 2 may use the above parameters $X_t$ and/or $C_t$, determined by the combiner 5, to set the recursive filtering coefficients a and b of the filters for the display brightness B and the strength S, thereby making the characteristics of the filters dependent on the positional status values.

The control parameter can be an average value of the ambient light obtained by filtering of the light values $x_i$. The average value, filtered in dependence on the positional status values, can be a more accurate estimate of the ambient light. The average value may be tuned to a specific purpose, such as the control of a display. When the light values are averaged using angular position values, a wide-angle measurement of the ambient light can be made using a narrow-angle light sensor. As the device orientation changes naturally in the hands of a user, the light values recorded will have different angular positions. The measurement at different angular positions allows simulation of a light sensor having different angular characteristics than the actual light sensor.

Figure 3:
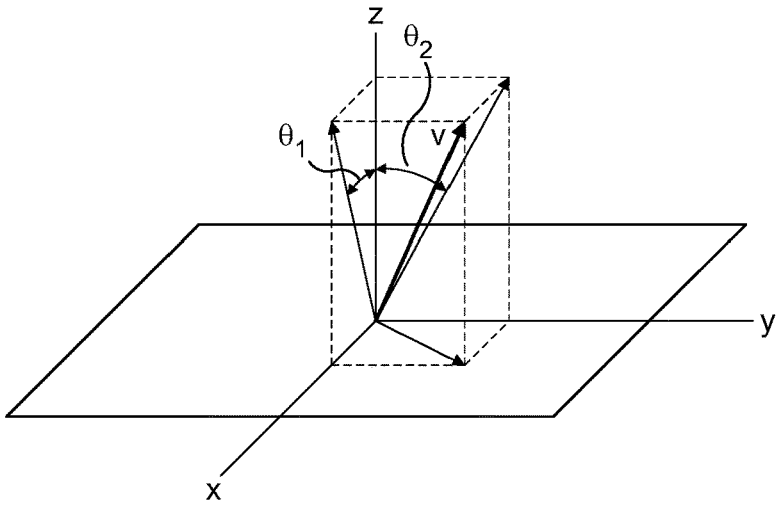
FIG. 3 shows an angular position in an x, y, z coordinate system.

FIG. 3 shows an angular position as a vector v in a rectangular x, y, z coordinate system. The z axis is the reference angular position and the angular position v at which a light value is measured forms angles $\theta_1$ and $\theta_2$ with the reference angular position.

The reference angular position may be set with respect to an external coordinate system, such as a system fixed to the surroundings or environment in which the light sensor captures the ambient light. The external coordinate system may be fixed to the earth. The position of the device with respect to the reference angular position may be determined using a gyro or a GPS as positional status sensor. Alternatively, the reference angular position may be set by the angular position of the positional status sensor, i.e. usually the angular position of the device, at a certain moment in time. In the embodiment of FIG. 1, the x, y plane can be the plane of the display 2 and the z axis the normal to the device 1 at the above-mentioned moment in time.

The reference angular position can be updated after fixed time intervals, e.g. by setting the reference angular position equal to the current direction perpendicular to the display 2, which may be determined using a gyro or a GPS. The reference angular position may also be a moving average over the angular positions of the positional status sensor over time. Alternatively, the reference angular position may be updated after a large change in orientation is detected, i.e. a change in angular position larger than a predetermined value, e.g. 10 degrees.

An angular filtering of the time-varying ambient light sensor readings can be defined as follows:

$$X=N^{-1}\iint x(\theta_1,\theta_2)f(\theta_1,\theta_2)d\theta_1\theta_2 \quad (3)$$

where x is an ambient light value recorded when the device is at a given orientation $\theta_1$, $\theta_2$; $f$ is an angular weighting function which is typically radially symmetric, N is a normalization factor, and X is the orientational average ambient light value. A single ambient light value X is thereby obtained from a sequence of ambient light samples recorded at different times while the device changes its orientation.

The value $X_i$ representing the value of X calculated at time i then replaces the time-sampled x in Eqs 1 and 2

$$B_i=\mathrm{LUT}(X_i);\langle B\rangle_i=(1-a)\langle B\rangle_{i-1}+aB_i \quad (5)$$

$$S_i=\mathrm{LUT}(X_i);\langle S\rangle_i=(1-b)\langle S\rangle_{i-1}+bS_i \quad (6)$$

A light sensor having a wide-angle lens can be simulated by choosing a function $f$ such that it weights the ambient light values acquired by a narrow-angle light sensor with a distribution which decreases with angle between the current angular position v at which the sensor measures the ambient light and the reference angular direction, such as a cosine function. Alternatively, different cosine functions in two perpendicular angular directions, e.g. as shown by $\theta_1$, $\theta_2$ in FIG. 3, may be used. The value of the cosine function can be taken from a look-up table (LUT). Thus weighted light values averaged over an angular range over which the device orientation changes simulates a measurement of the ambient light using a light sensor having a wide-angle lens. This value can be used to control the behavior of the device, for example to increase or decrease the display brightness.

When the cosine-function is replaced with a function that is uniformly distributed except for a narrow peak near the reference angular position, a combination of a narrow-angle ambient light sensor and a very wide-angle ambient light sensor is simulated. This allows for direct determination of the specular, haze and diffuse components of the ambient light.

It may be desirable to reset the filtering provided in Eq (4) whenever the device experiences a large or rapid displacement or orientational change, indicating that the device has moved into a different ambient light environment.

Figure 4:
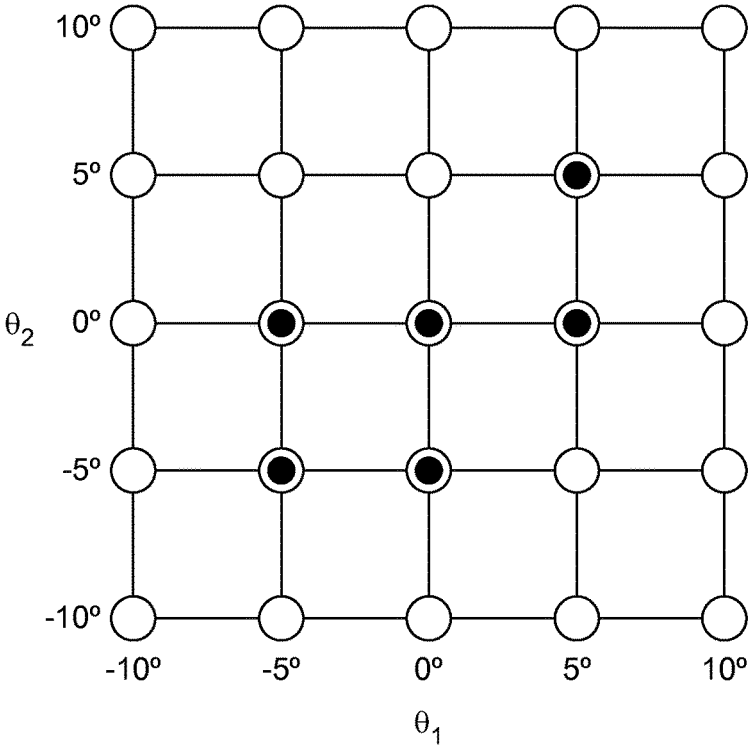
FIG. 4 shows a two-dimensional array of angular positions.

For computational purposes, it is convenient to map the measured light values onto a two-dimensional array of nodes at discrete angular positions θ1 and θ2, as shown in FIG. 4. The average ambient light value X can be expressed as:

$$X=N^{-1}\Sigma_{\theta_1}\Sigma_{\theta_2}x(\theta_1,\theta_2)f(\theta_1,\theta_2) \quad (4)$$

where now the sums run over discrete angular positions and the value x represents the ambient light sensor value sampled at the coordinate closest to a given ($\theta_1$, $\theta_2$) node in the array, weighted by a value dependent on the node position. In practice, only a subset of nodes will be occupied with ambient light values at a given time, as indicated by the black dots in FIG. 4, with the proportion of nodes occupied increasing over time as the device moves naturally in the environment. Therefore the summation in Eq (4) excludes unoccupied nodes. The normalization factor N is equal to the number of light values mapped onto the array. Although FIG. 4 shows a two-dimensional array, the light values can also be recorded in a one-dimensional array, where the angular positions correspond to the angle between the current angular position v and the reference angular position z. Multiple ambient light samplings at the same node may themselves be time-filtered in a number of ways, to determine an time-averaged value x($\theta_1$, $\theta_2$). For example, the most recent sample only may be retained; or a moving window average with a defined time-interval may be taken; or a recursive average with defined recursion coefficient may be used. The amount of time averaging at a node may be reduced compared to a stationary environment when the device is moving. Also the amount of time average at a node may be varied in dependence on the total number of samples N, for example so that less averaging is performed when the occupancy of the array is high while more averaging is performed when the occupancy is low and the accuracy of the orientational estimation of ambient light variation is correspondingly low.

The array of light values can be used to generate a map of the ambient light sources in the environment of the device. For example, a spot source will generate a characteristic pattern of high values at array positions corresponding to direct illumination, while a diffuse source will contribute uniformly to array positions. Such an ambient light map may be used to record for example from which direction sunlight is incident, e.g. through a window, and to adjust selectively device parameters such as screen brightness when the device is held facing to such a source. For example, array node values in excess of 1000 lux may typically indicate directions from which natural light is incident in the environment, while values less than 100 lux indicated directions in which the environment is in shadow.

Figure 5:
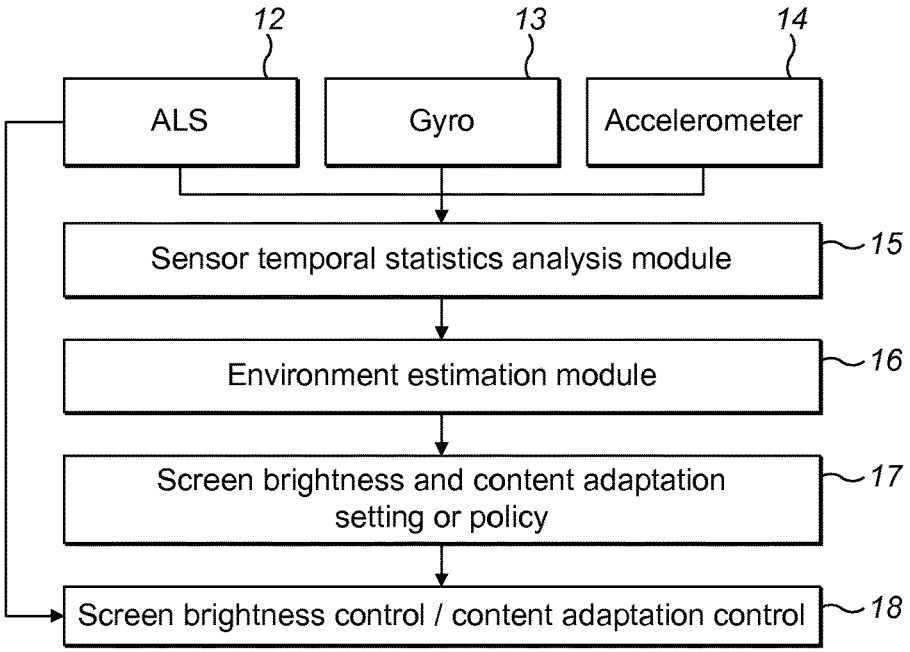
FIG. 5 shows a flow chart for controlling a display.

FIG. 5 shows an example of a method to determine the ambient light environment and to control a display. The method uses light values obtained from an ambient light sensor (ALS) 12, angular position from e.g. a GPS or gyro 13 and/or motion from an accelerometer 14. Statistical data of the measurements is obtained in the sensor temporal statistics analysis module 15, where parameters such as X and C may be calculated. The angular-position weighted average may be used to simulate a specific type of light sensor. The parameters are used to determine the most probable illumination environment in module 16. Module 17 sets the control policy in dependence on the environment; for a display control this involves setting the way in which the screen or display brightness and/or content adaptation must be controlled. In a particular embodiment, module 17 sets the filtering coefficients, such as the parameters a and b, for filtering the measured values in dependence on the environment determined in module 16. The control policy is applied in module 18, in which the actual screen brightness and content adaptation is set; in the particular embodiment the values for B and S are calculated.

Figure 6:
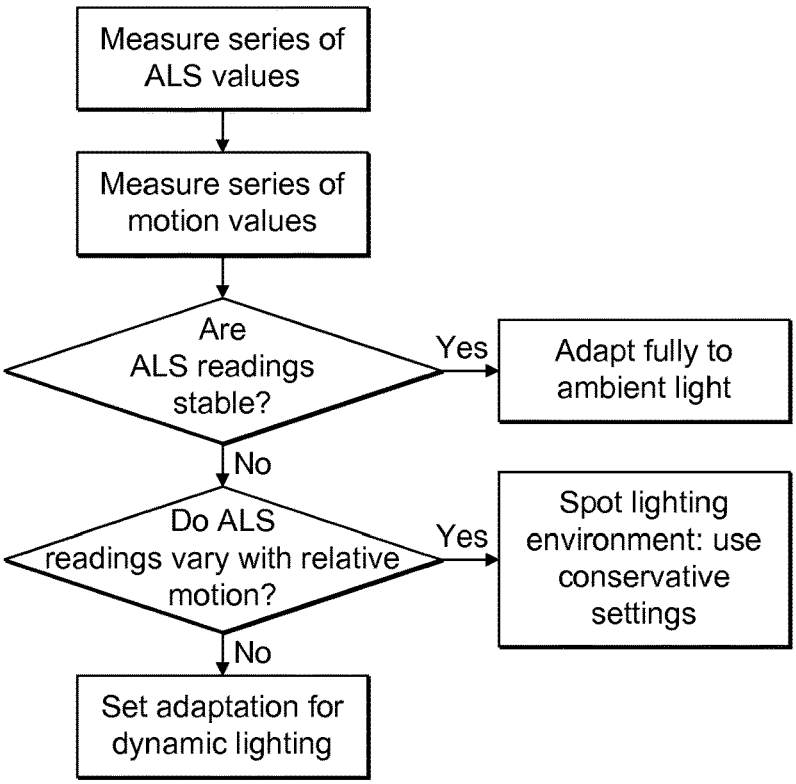
FIG. 6 shows a procedure for setting a control policy.

The following four exemplary scenarios show how the control parameters can distinguish between different viewing conditions. In the examples, the term 'high' is associated with an average sensor value which exceeds a noise threshold, set to exclude values below the accuracy of the measurement system, and 'low' with values below such a threshold. The four scenarios use an accelerometer as positional status sensor. Similar results can be obtained with any translational motion sensor. FIG. 6 shows a procedure for setting a policy for controlling a device such as a display using the scenarios. Although the measurement of light values and motion values in the Figure are shown as sequential, they may be carried out simultaneously.

In the first scenario the variance of the light value ll, $X_{ll,t}$, is low. Hence, the device is likely in diffuse lighting conditions. The display can be set to adapt smoothly to changes in light value. Since the device is stationary or moving slowly because of the small accelerometer value, a cautious adaptation to the light value is preferred; for example a=b=0.5. The control policy is shown in FIG. 6 as 'Adapt fully to ambient light'. The policy may have the additional condition that the average accelerometer value, $\langle x_{acc,t}\rangle$, is low.

In the second scenario the average accelerometer value is high and the variance of the light value is low. Since the changes in device position and/or orientation imply a sampling of the lighting environment and these samples show a low variance, it is probable that the device is in diffuse lighting. In such an environment the rate of adaptation can be increased, for example a=b=0.75.

In the third scenario the average accelerometer value is high and the variance of the light value is also high. This is suggestive of a spot lighting environment, where the measured light values are highly dependent on device position and/or orientation. Under such conditions, it is unsafe to adapt the display quickly to light value changes, implying or example a=b=0.05. The control policy is shown in FIG. 6 as 'Spot lighting environment: use conservative settings'.

In the fourth scenario the average accelerometer value is low and the variance of the light value is high. This is suggestive of a moving vehicle, where ambient light may vary rapidly while the device is held with relative stability. Here, the changes in ambient light may be due to passing under trees, in and out of shadows cast by buildings, or in and out of tunnels. To minimize the effect of the rapidly changing ambient light on the user's impression of the display, it is desirable to adapt the screen as rapidly as possible. To avoid the risk of visible flicker, this may be achieved by pixel brightness adjustment, which can be performed uniquely for each video frame, as opposed to screen brightness changes, which may yield observable flicker. For example, a=0.5, b=1. The control policy is shown in FIG. 6 as 'Set adaptation for dynamic lighting'.

The above four scenarios can be more accurately differentiated if alternative or additional positional status sensor information is available, e.g. by arranging an alternative or additional positional status sensors in the device. For example, an integrated gyroscope provides relative device orientation along each axis. If the covariance between light value and device orientation along an axis $C_t(X_{ll}, Y_{x\text{-}gyro})$ is high, this implies that the light value is a function of device orientation, which strongly indicates that the device is viewed in spot lighting conditions. The light values may be acquired by one or more further ambient light sensors, which can improve the differentiation between scenarios.

Figure 7:
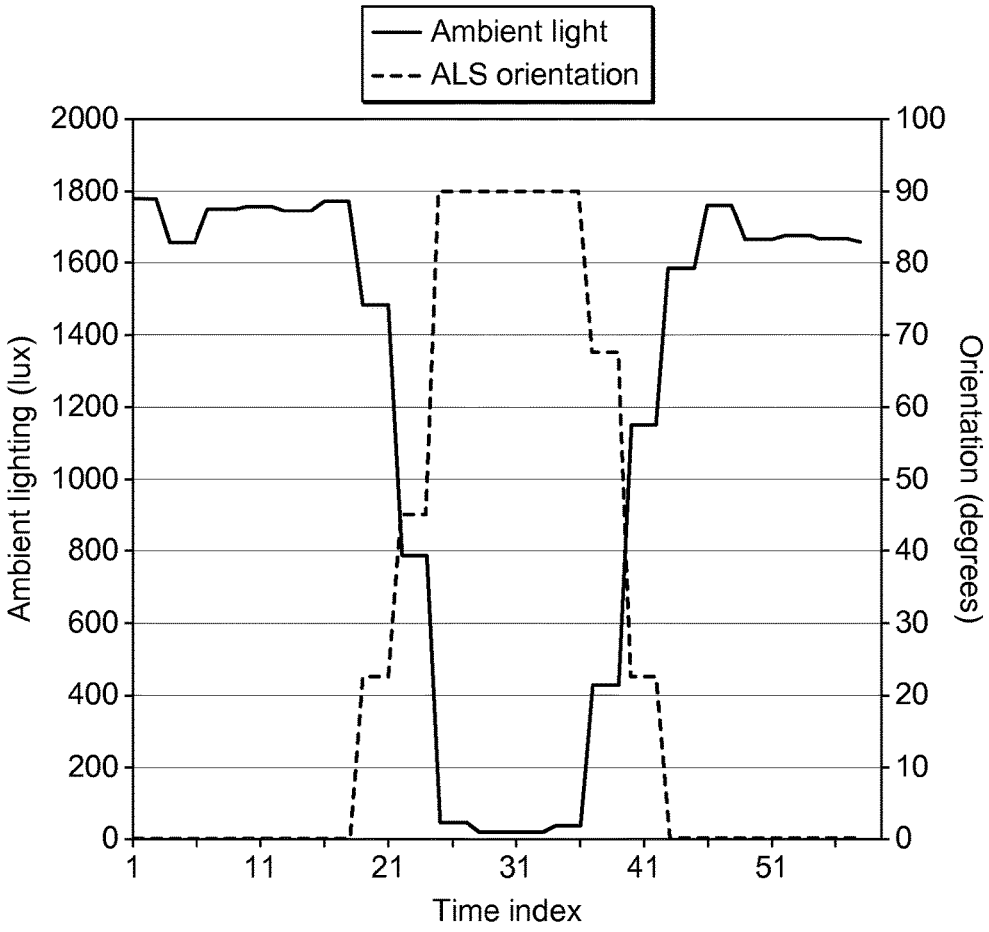
FIG. 7 shows a measurement of light value and of device orientation as a function of time.

The graph in FIG. 7 shows a measurement of the ambient light value recorded by an ambient light sensor mounted on the display and a measurement of the device orientation perpendicular to the plane containing the light source as a function of time when the device is rotated away from the light source. The covariance between these two measurements is high, approximately 0.85, implying that the change in measured light value is caused by the device rotation and that the device is probably in a spot light environment.

A GPS receiver may be used to differentiate more accurately the fourth scenario above, in which the device is being viewed within a moving vehicle. If accelerometer and gyroscope sensors indicate that the device is exhibiting a low degree of relative motion, while the GPS indicates the device is in uniform motion, changes in light value readings can be confidently associated with changes in ambient light.

The positional status sensor may be used to determine whether readings from the ambient light sensor are accurate or not. For example, when the display is in a preferred position, such as with the ambient light sensor on top, the readings will be accurate. If the positional status sensor detects that the ambient light sensor is not on top, for example because the display is held upside down, the measured light values may be inaccurate and the value of the control parameter may be kept at a constant value until the display is brought back to a preferred orientation.

An alternative application is a display of a mobile device, such as a mobile phone, on which a graphical application is shown, such as a video game, or an 'augmented reality' application where computer graphics are superimposed onto a video display. The graphics may be adjusted depending on the direction the device is pointing in relation to the sun to make the graphics blend well into the surroundings.

It will be understood that the processors or processing systems referred to herein may in practice be provided by a single chip or integrated circuit or plural chips or integrated circuits, optionally provided as a chipset, an application-specific integrated circuit (ASIC), field-programmable gate array (FPGA), etc. The chip or chips may comprise circuitry (as well as possibly firmware) for embodying at least one or more of a data processor or processors, a digital signal processor or processors, which are configurable so as to operate in accordance with the exemplary embodiments. In this regard, the exemplary embodiments of the method may be implemented at least in part by one or more computer programs stored in memory and executable by the processor, or by hardware, or by a combination of tangibly stored software and hard-ware (and tangibly stored firmware). The one or more computer programs may be stored on a record carrier.

The above embodiments are to be understood as illustrative examples. Further embodiments are envisaged. Alternative statistics will be evident to a person skilled in the art. For example, it may be desirable to correlate the rate of change of the light value measurements with the rate of change of device orientation. The values and formulae above are intended for illustration only and other alternatives will be evident to a person skilled in the art. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the accompanying claims.

What is claimed is:

1. A method of forming at least one control parameter dependent on ambient light, the method comprising:

acquiring light values from an ambient light sensor;

acquiring positional status values from a positional status sensor;

determining a variation of the light values over a time period;

determining a temporal covariance value between the light values and the positional status values over the time period;

applying a first temporal filtering of the light values to form a first control parameter for adjusting a display brightness of a display; and applying a second temporal filtering of the light values to form a second control parameter for adjusting pixel values of the display, the first temporal filtering different from the second temporal filtering, wherein at least one of the first control parameter or the second control parameter are formed in dependence on the temporal covariance value.

2. The method of claim 1, further comprising determining a correlation between the light values and the positional status values.

3. The method of claim 1, wherein the positional status values represent angular positions, respectively, and the method further comprises mapping the light values onto an array as a function of the angular positions.

4. The method of claim 3, wherein the angular positions are with respect to a reference angular position, the method further comprising setting the reference angular position according to an external coordinate system or according to a current angular position of the positional status detector after a fixed time interval after a change in angular position larger than a predetermined value.

5. The method of claim 1, further comprising forming at least one of a temporal, positional or orientational average of the light values.

6. The method of claim 1, wherein the positional status values represent angular positions, respectively, and the method comprises weighting the light values in dependence on the angular positions, respectively.

7. The method of claim 6, wherein the weighting is with a distribution which decreases with angle or a uniform distribution or a uniform distribution with a peak.

8. The method of claim 1, wherein the positional status values include motion.

9. The method of claim 1, wherein the ambient light includes diffuse illumination and spot illumination and at least one of a first value of the first control parameter or a second value of the second control parameter differentiates between the diffuse illumination and the spot illumination.

10. The method of claim 1, wherein at least one of a first value of the first control parameter or a second value of the second control parameter differentiates between changes in the light values due to changes in the ambient light and due to changes in a positional status of a device comprising the display.

11. The method of claim 1, comprising adjusting the display brightness of the display using the first control parameter and adjusting the pixel values of the display using the second control parameter.

12. The method according to claim 11, wherein the adjusting the pixel values comprises applying a gamma correction having an exponent dependent on the second control parameter.

13. The method of claim 1, wherein the display brightness increases with the light values.

14. The method of claim 1, comprising adjusting the pixel values such that a dynamic range of data to be displayed is smaller than or equal to a dynamic range of the display.

15. The method of claim 1, wherein the first control parameter is the display brightness and the second control parameter is a strength of dynamic compression.

16. The method of claim 1, further comprising acquiring light values from two or more ambient light sensors.

17. The method of claim 1, further comprising acquiring positional status values from two or more positional status sensors.

18. The method of claim 1, wherein the positional status relates to at least one of position and motion.

19. The method according to claim 1, comprising:

determining a mean light value representative of a mean of the light values over the time period; and determining a mean positional status value representative of a mean of the positional status values over the time period, wherein the temporal covariance value corresponds to a mean of a product of a deviation of the light values from the mean light value and a deviation of the positional status values from the mean positional status value.

20. The method according to claim 1, comprising setting at least one of a first recursive filtering coefficient for the first filtering or a second recursive filtering coefficient for the second filtering in dependence on the positional status values.

21. A system for forming at least one control parameter dependent on ambient light, the system comprising:

an ambient light sensor having an output to supply light values;

a positional status sensor having an output to supply positional status values; and a combiner, wherein:

the output of the ambient light sensor and the output of the positional status sensor are connected to inputs of the combiner, and the combiner is configured to:

determine a variation of the light values over a time period;

determine a temporal covariance value between the light values and the positional status values over the time period;

provide a first value of a first control parameter obtained by applying a first temporal filtering to the light values, for adjusting a display brightness of a display; and provide a second value of a second control parameter obtained by applying a second temporal filtering to the light values, for adjusting pixel values of the display, the first temporal filtering different from the second temporal filtering, wherein at least one of the first control parameter or the second parameter are formed in dependence on the temporal covariance value.

22. The system of claim 21, wherein the combiner is adapted such that at least one of the first value of the first control parameter or the second value of the second control parameter differentiates between diffuse illumination and spot illumination, where the ambient light includes the diffuse illumination and the spot illumination.

23. The system of claim 21, wherein the combiner is configured such that at least one of the first value of the first control parameter or the second value of the second control parameter differentiates between changes in the light values due to changes in the ambient light and due to changes in a positional status of a device comprising the display.

24. The system of claim 21, further comprising the display, wherein the display is arranged to receive the first control parameter and the second control parameter as inputs.

25. A non-transitory computer-readable storage medium comprising computer-executable instructions which, when executed by a processor, cause a computing device to form at least one control parameter dependent on ambient light by:

acquiring light values from an ambient light sensor;

acquiring positional status values from a positional status sensor;

determining a variation of the light values over a time period;

determining a temporal covariance value between the light values and the positional status values over the time period;

applying a first temporal filtering of the light values to form a first control parameter for adjusting a display brightness of a display; and applying a second temporal filtering of the light values to form a second control parameter for adjusting pixel values of the display, the first temporal filtering different from the second temporal filtering, wherein at least one of the first control parameter or the second control parameter are formed in dependence on the temporal covariance value.

* * * * *